United States Patent [19]

Nabinger

[11] 4,151,988

[45] May 1, 1979

[54] BRAKE MECHANISM FOR A TREADMILL

[76] Inventor: Herman G. Nabinger, 311 Kirk Ave., Syracuse, N.Y. 13205

[21] Appl. No.: 800,621

[22] Filed: May 26, 1977

[51] Int. Cl.[2] ..... A63B 23/06

[52] U.S. Cl. ..... 272/69; 188/72.9

[58] Field of Search ..... 272/69, 73, DIG. 3, 272/DIG. 4, 131, 132, 128; 128/25 R, 25 B; 280/217; 73/121, 123, 125, 379; 188/15, 58, 72.9, 79.5 GT, 79.5 K, 79.5 SS, 168, 169; 74/572

[56] References Cited

U.S. PATENT DOCUMENTS

| | | | |
|---|---|---|---|
| 216,076 | 6/1879 | Zweidinger | 188/15 |
| 1,211,765 | 1/1917 | Schmidt | 272/69 |
| 1,766,089 | 6/1930 | Wood | 272/69 |
| 2,315,485 | 4/1943 | Jones | 272/69 |
| 2,399,915 | 5/1946 | Drake | 272/69 |
| 3,709,197 | 1/1973 | Moseley | 272/69 X |

FOREIGN PATENT DOCUMENTS

| | | | |
|---|---|---|---|
| 2321813 | 11/1974 | Fed. Rep. of Germany | 272/69 |
| 1271191 | 7/1961 | France | 272/69 |
| 221620 | 8/1942 | Switzerland | 272/69 |

*Primary Examiner*—Richard C. Pinkham
*Assistant Examiner*—Arnold W. Kramer
*Attorney, Agent, or Firm*—Bruns & Jenney

[57] ABSTRACT

Apparatus for retarding the momentum of a treadmill including a flywheel operatively associated with the belt of the treadmill, a brake arranged to move into and out of engagement with the flywheel and a manually operated lever for operating the brake whereby a person on the treadmill can, at his or her option, retard or stop the motion of the treadmill.

7 Claims, 3 Drawing Figures

BRAKE MECHANISM FOR A TREADMILL

BACKGROUND OF THE INVENTION

This invention relates to an improved treadmill, and in particular, to manually operated apparatus for controlling the motion of the treadmill.

Typically, a treadmill is used as an exercising device to maintain physical fitness or to help rehabilitate people who have sustained injury or are recovering from an operation. Most treadmills involve an endless belt that is disposed about a series of rollers mounted within a stationary frame. A portion of the belt surface describes a "walking plane" upon which the person exercising strides or runs. Conventionally, the inclination of the walking plane may be adjusted to various positions in reference to the horizontal plane. At a relatively high angle of inclination, the exerciser is forced to exert considerably more energy than when the walking plane is in a relatively level position.

It is also important to the proper operation of the system that the exerciser can overcome the forces of friction allowing him to keep the system moving uniformly and smoothly. To this end, a flywheel arrangement is generally employed which is arranged to absorb any fluctuations in speed that might occur and thus impart a smooth motion to a person mounted upon the device.

Unfortunately, it is extremely difficult to obtain a smooth motion with a simple flywheel arrangement under all operating conditions. Situations can arise that are dangerous to the exerciser. For example, when the belt is easily movable, mounting and dismounting the treadmill can only be achieved with great difficulty. A weak or infirmed exerciser can thus lose his balance when attempting to mount or dismount the treadmill and sustain injury. Furthermore, the momentum of the system can overtake the ability of the exerciser to keep up causing a fall which, again, could prove to be harmful.

SUMMARY OF THE INVENTION

It is therefore an object of the present invention to improve treadmill type exercising devices.

A further object of the present invention is to improve the safety of a treadmill used for exercising.

Yet another object of the present invention is to provide an exerciser with greater control over the operation of a treadmill.

A still further object of the present invention is to provide a manually operated braking system for use in a treadmill to enable the user to override the natural momentum of the system.

These and other objects of the present invention are attained by a treadmill having an endless belt disposed about a series of rollers that are supported within a stationary frame so as to provide a walking plane upon which an exerciser strides, the treadmill further including at least one flywheel that is operatively attached to the belt for providing uniform momentum thereto, a braking means which is operable to engage the flywheel for retarding the motion of the system, and a manually operated actuating means which can be conveniently utilized by an exercising subject to move the brake means into and out of engagement with the flywheel at the exerciser's option when a potentially dangerous situation arises.

Adjustable control means are further provided which are arranged to act in conjunction with the braking system to enable the user to tension a brake pad against the flywheel whereby a constant friction force is transmitted to the endless belt.

BRIEF DESCRIPTION OF THE DRAWINGS

For a better understanding of the present invention as well as other objects and further features thereof, reference is had to the following detailed description of the invention to be read in connection with the accompanying drawings wherein.

DESCRIPTION OF THE PREFERRED EMBODIMENT

Figure 1:
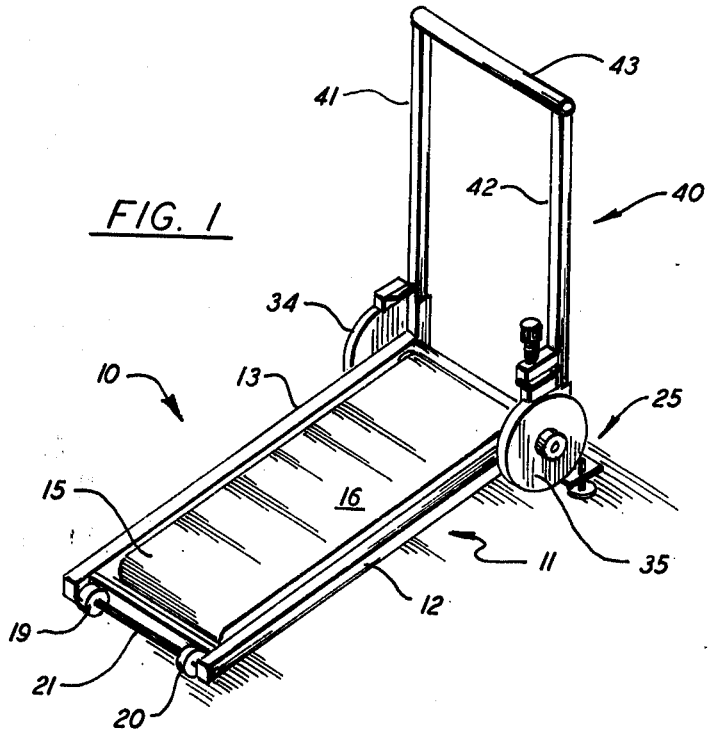
FIG. 1 is a perspective view of a treadmill incorporating teachings of the present invention.
Figure 3:
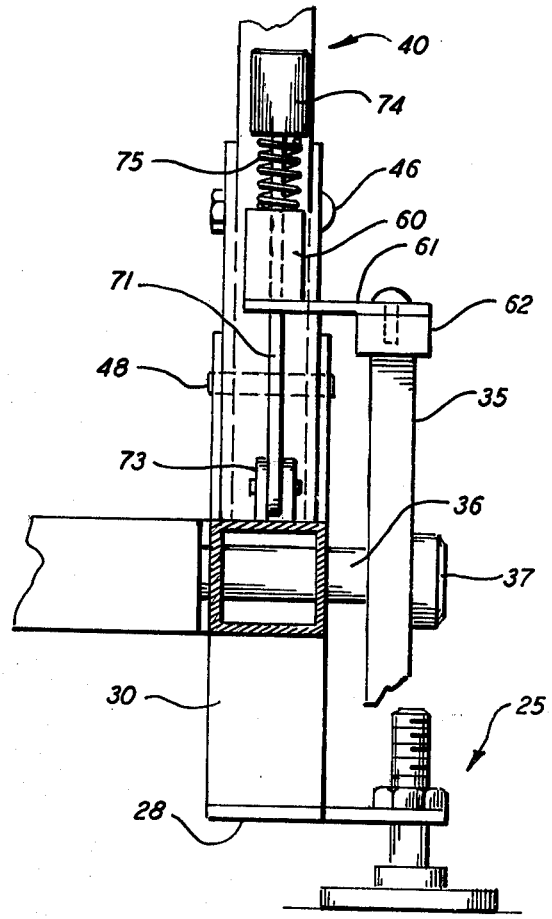
FIG. 3 is a partial end view of the treadmill shown in FIG. 2 also having portions broken away to more clearly illustrate the teachings of the present invention.

Referring now to the drawings, and in particular to FIG. 1, there is shown a treadmill 10 of typical construction which embodies the teachings of the present invention. As is well known in the art, the treadmill includes a stationary frame 11 having two side members 12 and 13 between which is supported a number of low friction rollers (not shown). Disposed about the rollers is an endless belt 15 which is supported within the frame as illustrated so as to provide a walking plane 16 upon which a person exercising stands or strides.

A pair of wheels 19, 20, which are supported upon a horizontally aligned axle 21, are rotatively supported within one end of the frame so that the wheels contact the floor or surface upon which the treadmill is resting. In practice, the wheels provide a convenient means for transporting the treadmill from one location to another.

Figure 2:
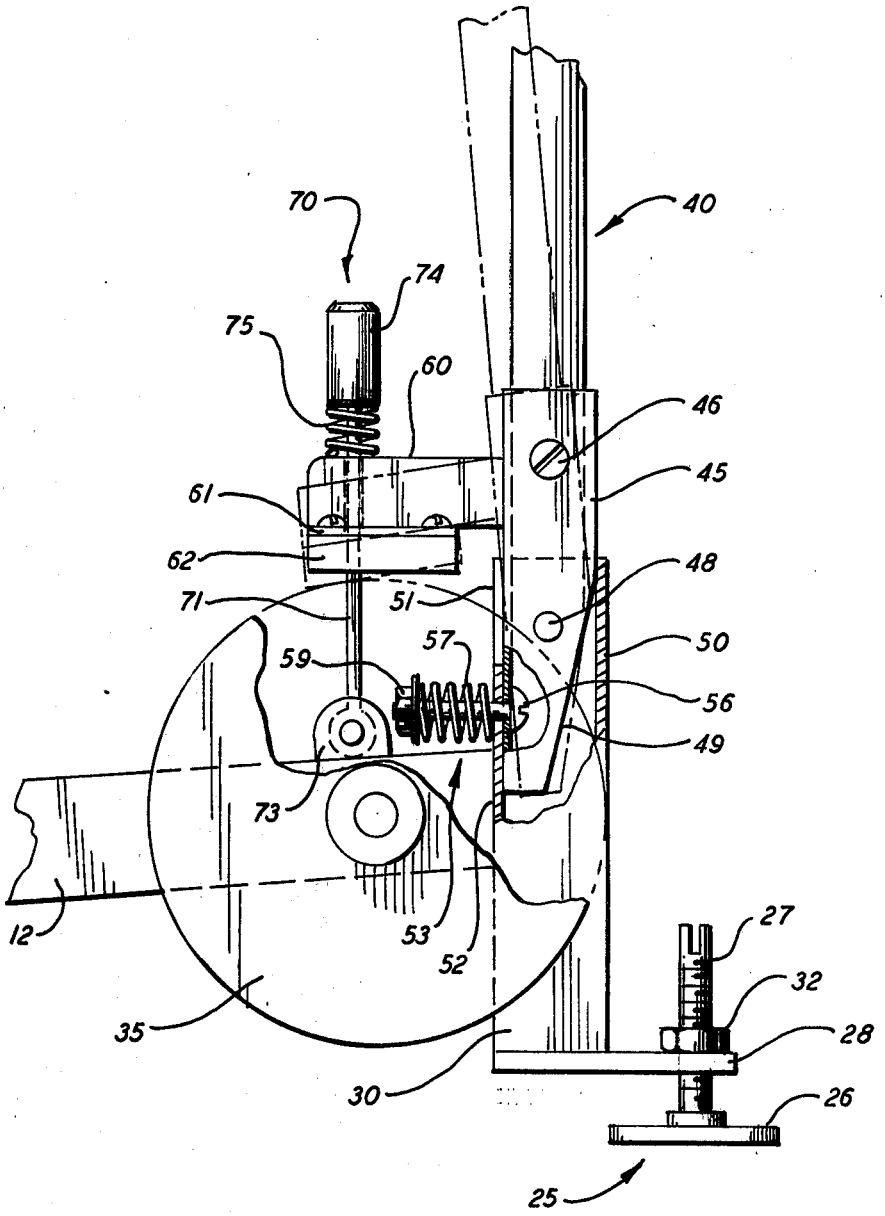
FIG. 2 is an enlarged partial side elevation with portions broken away of the treadmill shown in FIG. 1 further illustrating the teachings of the present invention.

At the opposite end of the frame, which will herein be referred to as the front end of the treadmill, are two adjustable foot pad assemblies generally referenced 25. As seen in FIG. 2, each assembly is provided with a pad or rest 26 which is affixed to a threaded shank 27. The shank, in turn, is threaded into a support member 28 which is welded to the bottom of a vertically extended frame member 30. The vertical frame member forms an integral part of the stationary frame 11. By turning the shank within the support member, the inclination of the frame, and thus the inclination of the walking plane, can be adjusted in regard to the surface upon which the treadmill is resting. In assembly, a locknut 32 is threaded down tight against the support member so as to secure the frame at any desired position within the adjusting range of the pad assemblies.

Referring once again to FIG. 1, a pair of flywheels 34, 35 are secured to the flywheel shaft 36 by means of pinned hubs 37 or any other suitable means. The flywheel shaft is arranged to pass through the two side members 12, 13 of the frame so that the flywheels are supported adjacent to the side members on the outside of the frame. Although not shown, the flywheel shaft is rotatably supported within the treadmill frame upon low friction bearings. The endless belt 15 is arranged to track about the flywheel shaft whereby the flywheels impart a uniform momentum to the belt system. As a result, a very smooth action is transmitted to an exerciser positioned upon the belt in the walking plane.

A handrail assembly 40 is pivotally supported within the stationary treadmill frame. The handrail consists of two upwardly extended parallely aligned arms 41, 42 that are cojoined by means of a cross member 43. The cross member is supported at an elevation whereby an exerciser situated upon the belt can conveniently grasp the cross member while still maintaining an upright posture.

The arms of the handrail and the previously noted stationary frame components are constructed of rectangular hollow metal beams formed of aluminum or any other suitable lightweight material having the required structural strength. The lower or terminal end of each arm is inserted into a complementary opening formed in a pivot arm 45 and is secured therein via screws 46 or the like. The pivot arms, in turn, are each inserted into a complementary opening contained in the previously noted vertical frame members 30 and are pivotally supported therein by means of pivot pins 48. A taper 49 is cut into the bottom back wall of each pivot arm that, in assembly, is situated opposite the rear wall 50 of vertical frame member 30. An opening 51 is also cut into the front wall 52 of each vertical frame member to a sufficient depth to permit the pivot arm, and thus the handrail secured therein, to rotate rearwardly in regard to the stationary treadmill frame.

A mechanical biasing device 53 (FIG. 2) is employed to continually urge the pivot arm, and thus the handrail, into vertical alignment with the stationary support member 30. This biased position will herein be referred to as the "home" position. The biasing device consists of an elongated screw 56 that is arranged to pass through the adjacent walls of the stationary vertical frame member 30 and the pivot arm 45. A tensioning spring 57 surrounds the body of the screw and is loaded into pressure contact against the outer wall of the vertical frame member by means of a nut 59. Sufficient clearance is provided between the screw body and the hole passing through the vertical frame member to permit the pivot arm to freely move about pivot 48 when the handrail is moved to a rearward position.

A support bracket 60 is secured, as by welding, to each pivot arm at a position somewhat above the pivot point thereof. The bracket contains a generally horizontally aligned plate 61 to which is affixed a brake pad 62. In assembly, the brake pads overlie the outer periphery of each flywheel as illustrated in FIG. 1. The pad can be formed of any suitable material having a low coefficient of friction and which exhibits good wear resistant properties.

The brake pads are normally supported in noncontiguous relation with each of the flywheels when the hand rail is forced back by the biasing means into the home position. When a subject who is exercising upon the treadmill finds himself in a dangerous situation, the handrail is simply pulled rearwardly as illustrated by phantom outline in FIG. 2 whereby the brake comes into retarding contact against the outer rim of the flywheel. Depending upon the amount of pressure applied, the brake engages the flywheel with sufficient force to cause the belt to slow down. When the dangerous situation has been alleviated, the pressure on the hand grip is released thereby allowing the hand grip to return to its home position. Sufficient pressure can also be applied to the brake mechanism through the manually operated lever system to completely stop the movement of the belt or to hold the belt stationary when in a stopped condition. This latter feature makes the mounting and dismounting the present treadmill relatively easy and safe particularly when the device is being utilized by an infirmed person.

As noted above, the torque on a treadmill is conventionally varied by adjusting the angle of inclination of the walking plane. This result is achieved in the present device by adjustment of the front mounting pads 25. There are times, however, when a high torque on the belt is desirable but a steeply inclined walking plane cannot be tolerated by the exerciser. To overcome this difficulty an adjustable brake control device, generally referenced 70, is herein provided to enable the exerciser to place a predetermined amount of torque upon the belt system without having to raise or lower the treadmill frame.

The adjusting mechanism includes an elongated stud 71 secured to the side member 12 of the frame by means of a clamp 73. The stud extends upwardly through a clearance hole passing through the support bracket 60 and terminates with a threaded knob 74. A spring 75 is interposed between the threaded knob 74 and the bracket 60 as best illustrated in FIG. 2. In operation, the exerciser can adjust the knob while positioned on the belt. Tightening the knob down forces the brake into friction contact against the flywheel surface. By so varying the amount of force exerted on the brake, the momentum of the treadmill system can be regulated at the exerciser's option. In assembly, the knob can be calibrated in reference to a stationary point upon the frame to provide a ready reference by which the exerciser can make accurate adjustments.

While this invention has been disclosed with reference to the structure disclosed herein, it is not confined to the specific details as set forth and this application is intended to cover any modifications of changes as may come within the scope of the following claims.

I claim:

1. In a treadmill having an endless belt disposed about a series of rollers which are supported within a stationary frame so as to provide a walking surface upon which a subject exercising on said treadmill strides, the improvement comprising a pair of axially aligned flywheels operatively associated with said belt for imparting a uniform momentum thereto, said flywheels being positioned on either side of said belt at one end of the walking surface, a handrail having two upwardly extending arms that are cojoined at the upper end thereof by a cross member suitable for gripping by a subject exercising upon the surface and the opposite ends of the arms being pivotally mounted in the frame adjacent to said flywheels, brake means affixed to each of the arms and each brake being arranged to move into and out of operable engagement with a respective flywheel when the hand rail is reciprocally rotated within aid frame, stop means associated with the handrail to limit its freedom of rotation in one direction so that said brake means is supported out of contact with said flywheel when the handrail is positioned against said stop means, and biasing means acting between the stationary frame and said handrail for holding the handrail against the stop whereby pulling the handrail against the force of the biasing means will immediately move the brake means against the flywheels.

2. The improvement of claim 1 wherein said brake means includes friction pads arranged to move downwardly into contact with the outer rim of the flywheels in response to the movement of said hand rail.

3. The improvement of claim 2 further including an adjustable control means affixed to the frame and arranged to act against the brake means to position the brake means in friction contact against the flywheel to provide a predetermined torque to the treadmill belt.

4. The improvement of claim 3 further including adjusting means operatively associated with said control means for regulating the amount of torque applied to said belt.

5. The improvement of claim 1 wherein said biasing means is a tension spring arranged to pull the arms of said hand rail against the stop means.

6. A treadmill having an endless belt disposed about a series of rollers supported within a stationary frame to provide a planar walking surface upon which a subject that is exercising can stride, the treadmill further including at least one flywheel operatively associated with the endless belt for imparting a uniform momentum thereto, a brake that is operable to engage the flywheel and retard its motion, a lever pivotably supported in the frame and extending upwardly therefrom to an elevation such that the lever is hand operable by a subject mounted upon the walking surface, the lever being affixed to said brake for moving said brake into and out of engagement with the flywheel, and a biasing means secured to the frame and arranged to act against the lever to normally hold the brake out of contact with the flywheel whereby moving said lever against the force of said biasing means will immediately activate said brake.

7. The treadmill of claim 6 further including an adjustable tensioning means secured to the frame and being arranged to act against the brake in opposition to the biasing means whereby the brake may be tensioned against the flywheel with a predetermined force.

* * * * *